US005138811A

United States Patent [19]

Parrott

[11] Patent Number: 5,138,811

[45] Date of Patent: Aug. 18, 1992

[54] WINDOW

[76] Inventor: Michael Parrott, Lambeth Road, Reddish, Stockport, Cheshire, England

[21] Appl. No.: 721,401

[22] Filed: Jun. 26, 1991

Related U.S. Application Data

[63] Continuation of Ser. No. 70,439, Jul. 7, 1987, abandoned.

[30] Foreign Application Priority Data

Jan. 14, 1987 [GB] United Kingdom ..... 8700786

[51] Int. Cl.[5] ..... E04B 1/62; E04F 15/14

[52] U.S. Cl. ..... 52/400; 52/397

[58] Field of Search ..... 52/397, 400

[56] References Cited

U.S. PATENT DOCUMENTS 2,761,535 9/1956 Englehart ..... 52/400

4,555,884 12/1985 van Eerden ..... 52/400 X

*Primary Examiner*—David A. Scherbel

*Assistant Examiner*—Kien Nguyen

*Attorney, Agent, or Firm*—Charles J. Brown

[57] ABSTRACT

There is disclosed a window of the kind having at least one light comprised by a non-metallic rectangular frame of wood or wood substitute material wherein said rectangular frame has a rebate around the inner edge of its outer face, a first extruded section secured to the walls of the rebate lying in the plane of the frame, a second extruded section engaged with said first section so as to be restrained against outward movement, resilient sealing strips on opposite inner edges of said first and second sections and a glazing unit firmly gripped around its perimeter between said sealing strips.

4 Claims, 1 Drawing Sheet

WINDOW

This is a continuation of application Ser. No. 07/070,439, filed Jul. 7, 1987, now abandoned, entitled Window.

This invention concerns a window of the kind (hereinafter termed as the kind referred to) having at least one light comprised by a non-metallic rectangular frame of wood or wood substitute material. Generally, though not necessarily, there will be several such lights separated by mullions and transoms some of which lights may be fixed and other of which may be openable.

Many glazing systems are known for supporting sealed double-glazed units within an inner frame formed from extruded aluminium or plastics sections which is then usually mounted in a surrounding outer frame of timber. Disadvantages of such systems include the untraditional appearance of the two frames from the inside and on the possibility of condensation on the inner surfaces of the inner frame particularly when of metal.

The mounting of single glass sheets or sealed double glazing units directly into a timber frame has necessitated a labour intensive operation involving the use of putty and beading both of which can deteriorate and require maintenance or replacement before other parts of the window.

It is an object of the present invention to provide a window which overcomes the disadvantages aforesaid.

According to the present invention there is provided a window of the kind referred to wherein said rectangular frame has a rebate around the inner edge of its outer face, a first extruded section secured to the walls of the rebate lying in the plane of the frame, a second extruded section engaged with said first section so as to be restrained against outward movement, resilient sealing strips on opposite inner edges of said first and second sections and a glazing unit firmly gripped around its perimeter between said sealing strips.

The glazing unit may be a sealed double-glazed unit.

The first and second extruded sections may have complementary interengageable hook-like formations.

The second extruded section may have a tongue receivable in a channel formation in the first extruded section.

The first extruded section may be dimensioned so as not to extend inwardly of the rebated portion of the frame.

The first extruded section may include a portion of 'fir-tree' section adapted to be forced into a groove in a wall of the rebate for securement.

The invention will be further apparent from the following description with reference to the several figures of the accompanying drawing, which show, by way of example only, one form of window embodying same. Of the drawing FIG. 1 is an interior elevation of the window;

Figure 1:
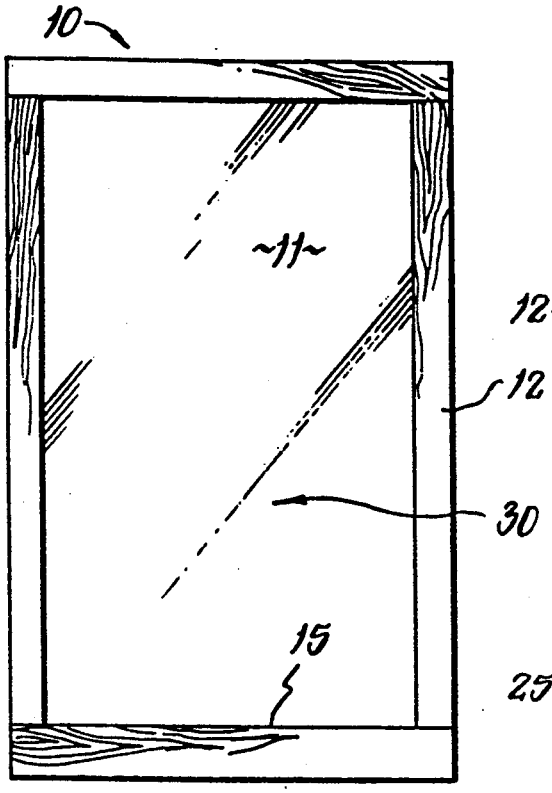
Figure 2:
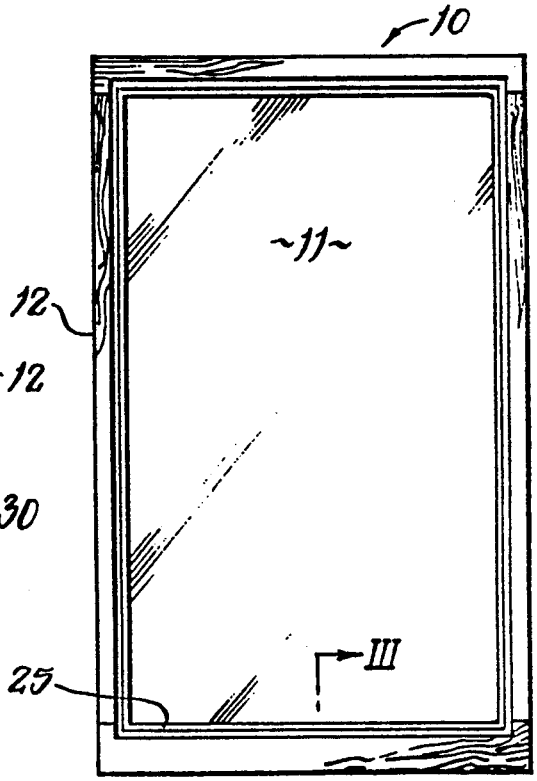
FIG. 2 is an exterior elevation of the window of FIG. 1.

Referring now to the drawing it will be seen that the window 10 comprises a single fixed light 11 positioned within a surrounding rectangular wooden frame 12. It will be understood that the window might comprise a plurality of lights some of which might be fixed and others might be opening.

Figure 3:
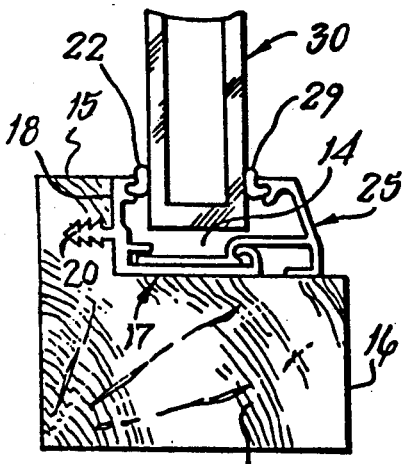
FIG. 3 is a cross-section through the window on the line III—III of FIG. 2.

As best seen from FIG. 3 the frame 12 has a rebate 14 around the inner edge 15 of its outer face 16.

Figure 4:
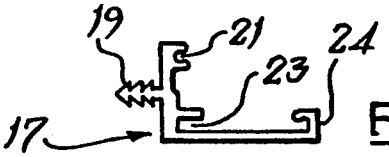
FIG. 4 is a cross-section through a first extruded section used in the construction of the window of FIG. 1.

A first extruded aluminium section 17 (see FIG. 4) is secured to the walls 18 of the rebate 14 lying in the plane of the frame 12. In this example the section 17 is secured by means of an integral portion 19 of 'fir-tree' section which is forced into a groove 20 in the walls 18.

The section 17 is of generally L-shape having a slot 21 at its inner edge which locates a resilient sealing strip 22, and a channel formation 23 and hook formation 24.

Figure 5:
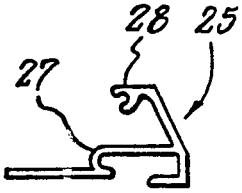
FIG. 5 is a cross-section through a second extruded section used in the construction of the window of FIG. 1.

A second extruded aluminium section 25 (see FIG. 5) has a tongue 26, a hook formation 27 and slot 28 on its inner edge which locates a resilient sealing strip 29, and is engaged with the first section 17 to firmly grip a sealed double-glazing unit 30 around its perimeter between the oppositely disposed sealing strips 22 and 29.

Engagement of section 25 with section 17 is through location of tongue 26 in channel formation 23 and coupling of the hook formations 24 and 27 to restrain the section 25 from outward movement The section 17 is dimensioned so as not to extend inwardly of the rebate 14 so as to be unseen when the interior of the window 10 is seen in elevation (FIG. 1).

Any condensation forming on the sections 17 and 25 is constrained to drain to the outside of the wall in which the window 10 is fitted.

Figure 6:
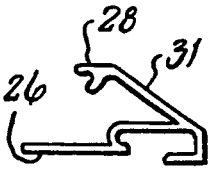
FIG. 6 is a cross-section through a modified second extruded section.

The shape of the second section 25 may be modified as shown in FIG. 6 by adjusting the angle of the web 31 connecting slot 28 with tongue 26 to adapt for a glazing unit 30 of different thickness.

It will be appreciated that it is not intended to limit the invention to the above example only, many variations, such as might readily occur to one skilled in the art, being possible, without departing from the scope thereof as defined by the appended claims.

Thus, for example, the portion 19 of section 17 may be omitted, and the section secured by screws, nails or adhesive.

I claim:

1. A window frame edge assembly in combination with an outwardly facing rebate on the perimeter of a window opening and a glazing for the window opening, the rebate comprising a wall substantially co-planar with the window opening and an outwardly extending surface joining said wall remote from the opening, the edge assembly comprising a) a first elongated rigid section in the rebate affixed to at least one of said rebate wall and surface and engaging both said rebate wall and surface, b) a second elongated rigid section in the rebate engaging the outside of the glasing and partially overlying the first section and engaged therewith so as to be restrained against outward movement only by the first section, c) the second section being installed from outside the glazing, and d) a pair of opposed spaced sealing strips on the respective first and second sections for firmly gripping the glazing therebetween.

2. A window frame edge assembly according to claim 1 wherein the first section is affixed to said rebate wall.

3. A window frame edge assembly in combination with an outwardly facing rebate on the perimeter of a window opening, the rebate comprising a wall substantially co-planar with the window opening and an outwardly extending surface joining said wall remote from the opening, the edge assembly comprising a) a first elongated rigid section affixed to said rebate wall, b) a portion included in said first section of "fir-tree" configuration force-fitted into the rebate wall, c) a second elongated rigid section partially overlying the first section and engaged therewith so as to be restrained against outward movement only by the first section, and d) a pair of opposed spaced sealing strips on the respective first and second sections for firmly gripping a glazing therebetween.

4. A window frame edge assembly in combination with an outwardly facing rebate on the perimeter of a window opening, the rebate comprising a wall substantially co-planar with the window opening and an outwardly extending surface joining said wall remote from the opening, the edge assembly comprising a) a first elongated section disposed against both the rebate wall and surface, b) a portion of "fir-tree" configuration on said first section force-fitted into the rebate wall, c) a second elongated section, d) complementary interengageable hook-like formations on the first and second sections being the only means of restraining the second section against outward movement and comprising a tongue on the second section and a channel in the first section for receiving said tongue, e) the second section including one portion separate from the hook-like formation engaging and partially overlying the first section and another portion engaging said surface, f) the first and second sections being dimensioned so as not to extend beyond said wall into the window opening or outwardly beyond said surface, and g) a pair of opposed sealing strips on the respective first and second sections for firmly gripping the glazing therebetween.

* * * * *